United States Patent [19]

Jalil et al.

[11] Patent Number: 4,580,353

[45] Date of Patent: Apr. 8, 1986

[54] APPARATUS AND METHOD FOR AIR COOLING HOT ROLLED STEEL ROD

[75] Inventors: Asjed A. Jalil, Holden; Charles H. Gage, Westborough, both of Mass.

[73] Assignee: Morgan Construction Company, Worcester, Mass.

[21] Appl. No.: 666,917

[22] Filed: Oct. 31, 1984

[51] Int. Cl.[4] ..... F26B 7/00; C21D 9/52; C21D 9/56; F27D 15/02

[52] U.S. Cl. ..... 34/20; 148/156; 266/106; 432/59; 432/80

[58] Field of Search ..... 432/59, 80; 34/20; 266/106; 148/12 B, 156

[56] References Cited

U.S. PATENT DOCUMENTS

| | | | |
|---|---|---|---|
| 3,832,788 | 9/1974 | Kato et al. | 34/20 |
| 3,930,900 | 1/1976 | Wilson | 148/12 B |
| 4,448,401 | 5/1984 | Jailil et al. | 266/106 |

*Primary Examiner*—John J. Camby

*Attorney, Agent, or Firm*—Thompson, Birch, Gauthier & Samuels

[57] ABSTRACT

A conveyor has successive mutually spaced driven rollers in which hot rolled steel rod is transported in the form of overlapping offset rings. The rings are rapidly air cooled by first nozzles which direct first jets of cooling air upwardly to impinge against and to flow around the conveyor rollers, and by second nozzles which direct second jets of cooling air upwardly between the rollers. The first and and second jets of cooling air produce respective first and second velocity profiles, each having an average velocity. The arrangement of the first and second nozzles in relation to each other and to the conveyor rollers is such that the velocity profiles of the first and second jets are superimposed one over the other to produce a broader combined velocity profile having an average velocity greater than that of either the first or second velocity profiles.

8 Claims, 9 Drawing Figures

APPARATUS AND METHOD FOR AIR COOLING HOT ROLLED STEEL ROD

BACKGROUND OF THE INVENTION

1. Field of the Invention

This invention relates generally to the controlled cooling of hot rolled steel products such as rods and the like in direct sequence with the rolling operation in order to achieve predetermined metallurgical properties, and is concerned in particular with an improved apparatus and method for increasing the rate at which such products may be air cooled.

2. Description of the Prior Art

The controlled air cooling of hot rolled steel rod in direct sequence with the rolling thereof began approximately twenty years ago with the process described in U.S. Pat. No. 3,231,432 (McLean et al). This process involves hot-rolling the rod and thereafter directly coiling it onto an open conveyor in spread out ring form while the microstructure of the steel is still in a condition of highly uniform, relatively small austenite grain size. While moving along the conveyor, the rings are air cooled through allotropic transformation. This produces a microstructure sufficiently equivalent to that achieved by air or lead patenting so as to enable the rod to be subsequently processed to a finished product, as for example by being drawn into wire, without additional heat treatment.

In the earlier installations of this process, chaintype conveyors were employed. However, because of the tendency of the rings to undergo scratching as a result of their being dragged over stationary support rails located between the chains, and because prolonged area contact with such rails produces non-uniform cooling, the use of chain-type conveyors was eventually discontinued to a large extent in favor of roller conveyors of the type shown for example in U.S. Pat. No. 3,930,900 (Wilson). Here, the rings are transported over driven rollers, with air nozzles arranged between the rollers to blow cooling air upwardly through the rings. The rod sizes that are processed on installations of this type typically range from about 5–19 mm. in diameter, and the typical cooling rates that can be achieved at static water pressures of between about 7"–10" are shown by the curves $x_1$ and $x_2$ of FIG. 1. Curve $x_1$ represents the cooling rate at the sides of the conveyor where the overlapped rings are more densely packed, as compared to the center of the conveyor, where the ring density is less and the cooling rate is more rapid, as represented by curve $x_2$. The vertical distance between curves $x_1$, $x_2$ is an indication of the non-uniformity of cooling being experienced for a particular rod size. It will be observed that as the rod size increases, there is a decrease in the cooling rates. This is due to the decrease in the ratio of surface area to volume which characterizes the larger rod sizes. For high carbon steels such as for example AISI 1085, the cooling rates of curves $x_1$, $x_2$ yield average tensile strengths depicted by the curve "X" of FIG. 2. When compared with curve "Z" of FIG. 2, which depicts the tensile strengths achievable with conventional lead patenting, the results depicted by curve X are uniformly lower for all rod sizes.

Improvements in uniformity of cooling and flexibility of operation have been achieved by arranging the air cooling nozzles directly under the conveyor rollers, as shown for example in U.S. Pat. No. 4,448,401 (Jalil et al). However, unless static air pressures are increased significantly, which of course increases power consumption and operating costs, such arrangements do not increase the rate at which the rings are cooled.

Attempts also have been made at achieving increased cooling rates by employing water as a cooling medium. See for example U.S. Pat. No. 4,395,022 (Paulus et al) which describes an apparatus for cooling hot rolled steel products, including rod, by immersion in a water bath. Cooling by water immersion has reportedly achieved somewhat accelerated cooling rates with improved tensiles for larger rod sizes. However, uniform results have been difficult to achieve. This is due to the difficulty of maintaining optimum water chemistry, a problem which is compounded by the need to continuously remove contaminants such as dirt, mill scale, etc. from the water bath. Experiments also have been conducted with water sprays, but here again uniformity has proven to be elusive.

Thus, the cooling curves $x_1$, $x_2$ of FIG. 1 and the resulting average tensile strengths X of FIG. 2 remain representative of current commercial practice when rapidly cooling hot rolled steel rod in direct sequence with the rolling operation.

This has necessitated certain compromises on the part of rod producers. More particularly, when producing rod sizes below about 9 mm., the average tensile strengths of curve X have been considered as being acceptable for most commercial purposes, despite the fact that they are significantly lower than those attainable by off-line processes such as lead patenting (curve Z). However, when producing rod sizes of 9 mm. and above, the tensile strengths of curve X are considered to be unacceptable. Consequently, most mills either draw wire to greater reductions, or use alloying elements to increase the hardenability of the steel, or resort to off-line lead or salt patenting heat treatments. The first of these alternatives yields mixed results, and the second and third alternatives significantly increase tonnage costs.

It thus will be seen that, the prior art has failed to satisfactorily meet the demands of the industry when processing the larger rod sizes ranging from 9 to 19 mm. in diameter.

SUMMARY OF THE PRESENT INVENTION

The primary objective of the present invention is the provision of a method and apparatus for significantly increasing the rate at which offset overlapping rings of hot rolled steel rod may be air cooled on a roller conveyor, thereby making it possible to impart acceptably high tensiles to the larger diameter rods.

The present invention stems from the discovery that the rate at which the overlapping offset rings may be air cooled on a roller conveyor can be increased significantly by broadening the distribution of the air streams being successively applied to the rings as they move over the conveyor rollers, and by increasing the average velocity of such air streams. This is accomplished by directing first jets of cooling air upwardly to impinge against and to flow around the conveyor rollers, and by directing second jets of cooling air upwardly between the rollers. The first and second jets produce respective first and second velocity profiles, each having its own average velocity. The first and second velocity profiles are superimposed one over the other to produce a combined velocity profile having an average velocity which is significantly higher in comparison to that of either the first or second velocity profiles. The combined velocity profile extends over a substantially greater length of the path of ring travel, thereby significantly lengthening the exposure time of the rings to the higher average velocity air flow. The net result is a significantly increased cooling rate as compared with prior art air cooling arrangements.

DESCRIPTION OF PREFERRED EMBODIMENT

Figure 2:
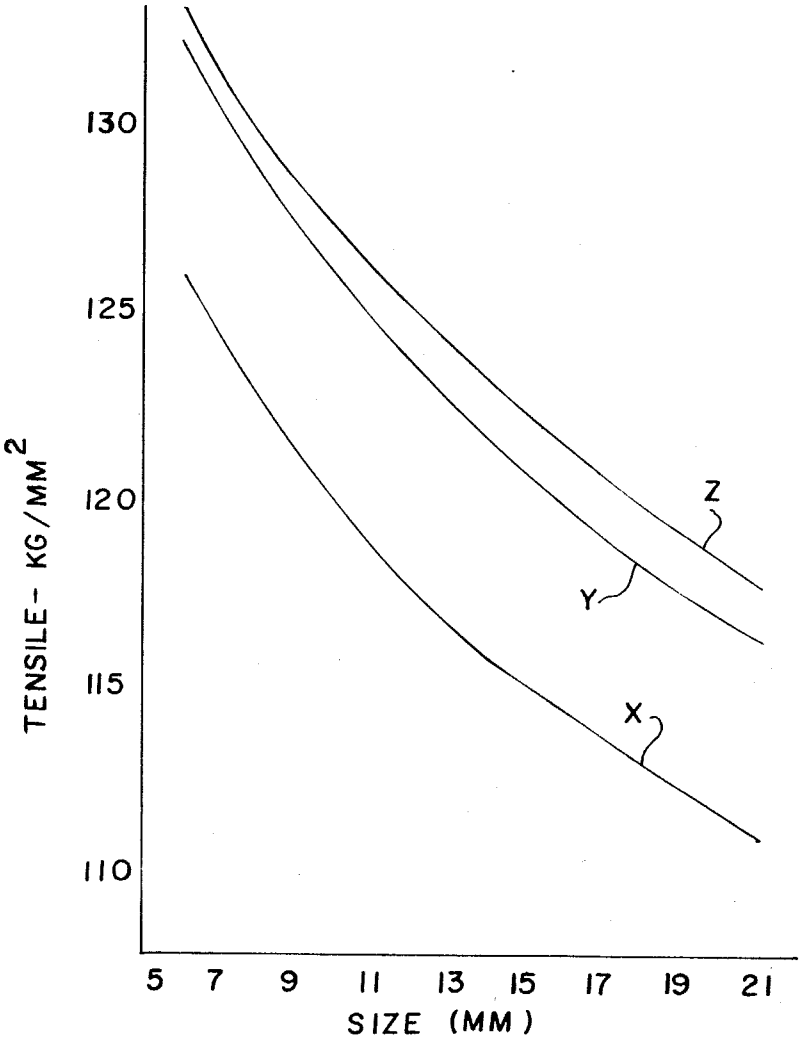
FIG. 2 is a graph comparing tensile strengths produced by lead patenting with those achievable with the cooling rates of FIG. 1.

Referring to FIGS. 3-6, a conveyor in accordance with the present invention is shown comprising mutually spaced rollers 10 extending through and beyond the conveyor side walls 12 where they are rotatably supported by bearings 14. Each roller is provided with an outboard sprocket 16 adapted to be engaged by a conventional chain drive (not shown). The rollers define a transport surface which is adapted to move overlapping mutually offset rings 18 of hot rolled steel rod in the direction indicated by arrow 20 in FIGS. 3 and 5.

The rollers 10 overlie a deck 22 which forms the roof of a plenum chamber 24. The plenum chamber is supplied with cooling air by conventional means, such as for example motor driven fans (not shown). As can be best seen in FIG. 6, the deck 22 is comprised of mutually spaced channel members 26. The channel members contain mutually opposed partially cylindrical sleeves 28 between which are mounted rotatable bars 30. The spaces between the outer surfaces of the sleeves 28 and the interior channel surfaces are filled with a cast refractory material 32. The spaces between the channel members 26 form first nozzles 34 which extend across the width of the conveyor at locations directly underlying the rollers 10. These first nozzles are arranged to direct first jets of cooling air upwardly from the plenum chamber 24 to impinge against and to flow around the rollers. The bars 30 are slotted to define second nozzles 36 which in the "open" positions shown by the solid lines in FIG. 6, underlie the spaces between the rollers 10 and communicate with underlying slots 38 in the bottom webs of the channels. When in the open position, the nozzles 36 are arranged to direct second jets of cooling air from the plenum chamber upwardly between the rollers 10. For reasons which will hereinafter be explained, the bars 30 may be rotatably adjusted to "closed" positions indicated by the dot-dash lines at 36'. This adjustment may be effected by any convenient means, such as for example crank arms 40 located exteriorily of the plenum chamber 24.

Figure 4:
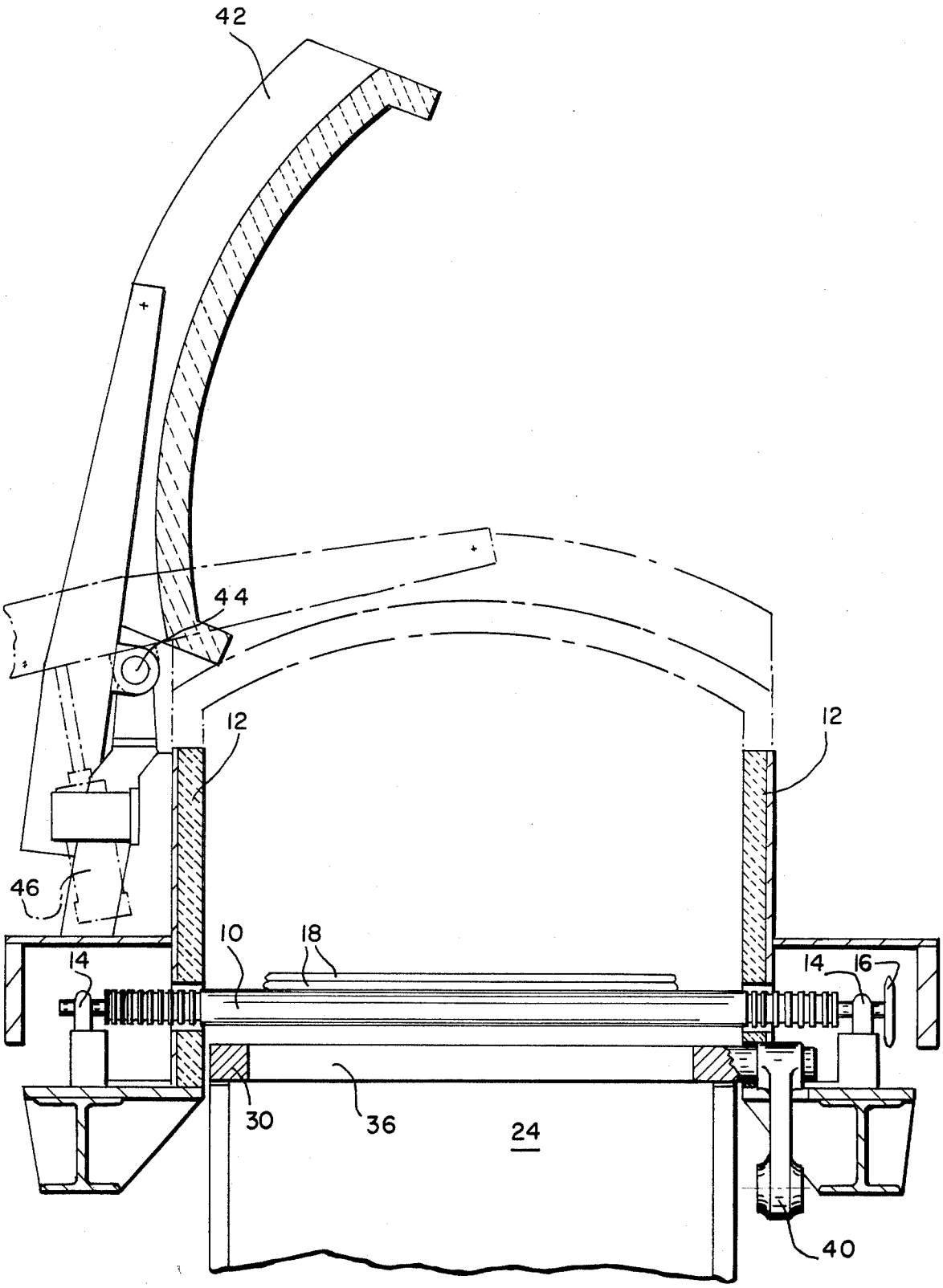
FIG. 4 is a sectional view taken along line 4—4 of FIG. 3.
Figure 5:
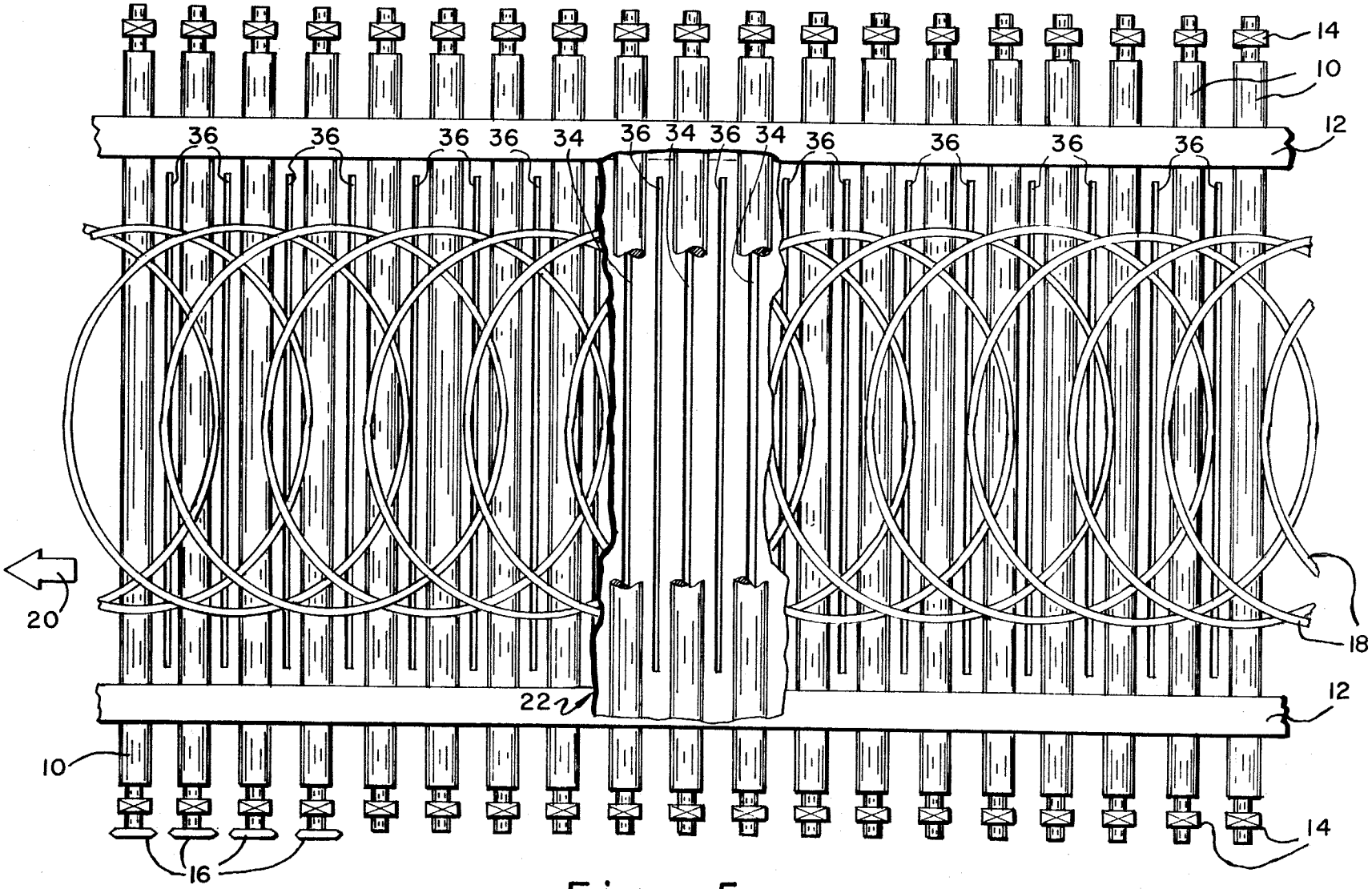
FIG. 5 is a plan view of the conveyor portion shown in FIGS. 3 and 4 with the cover removed.
Figure 6:
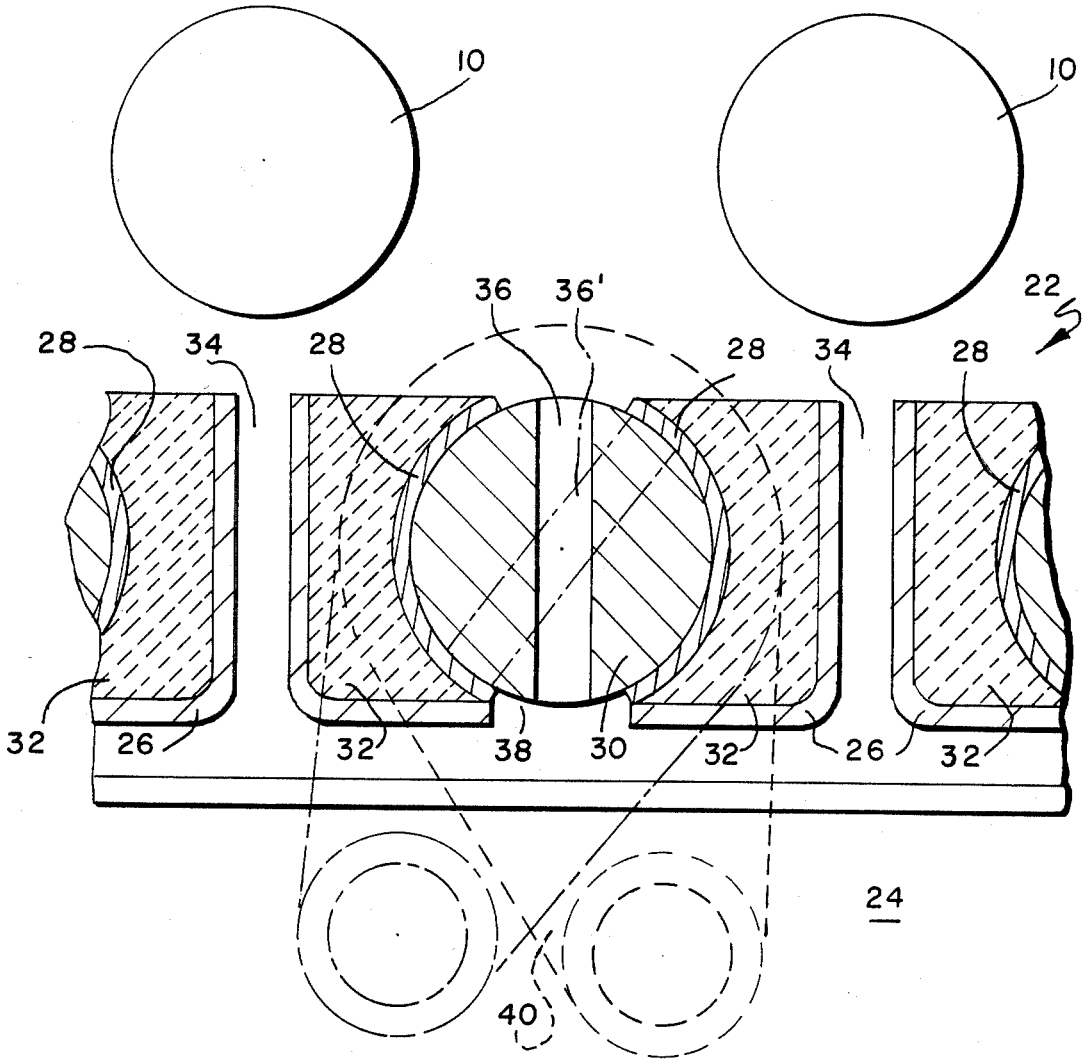
FIG. 6 is an enlarged detail, in section, of the conveyor deck.

A conveyor cover 42 is pivotally mounted as at 44, and is adapted to be adjusted by means of a piston-cylinder unit 46 between an open position as shown by the solid lines in FIG. 4, and a closed position indicated by the broken lines in the same view. In the accelerated cooling mode of operation, the cover is maintained in the open position.

Figure 7A:
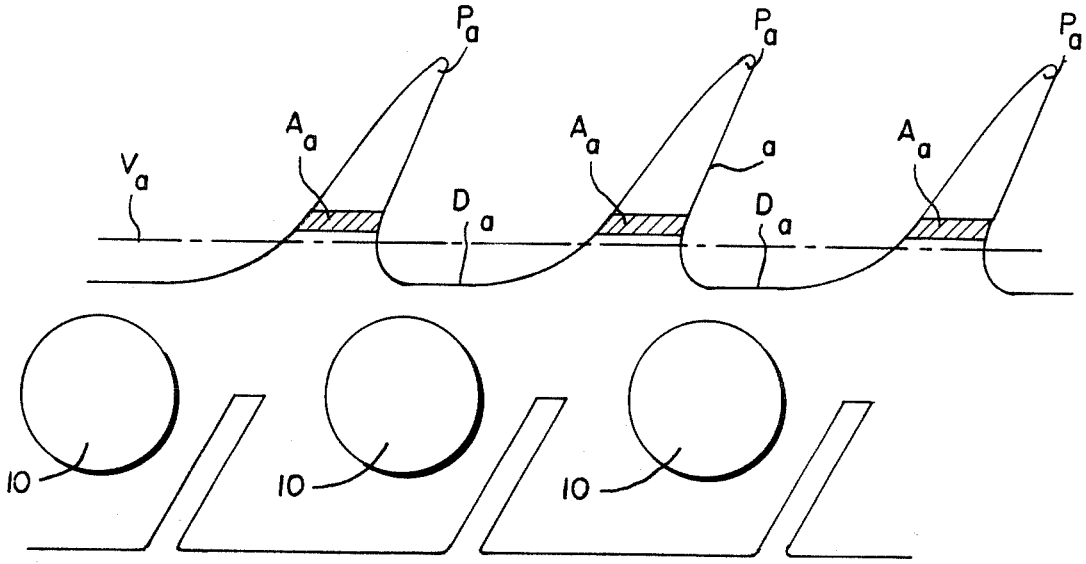
FIG. 7A is a diagrammatic illustration of the air jet velocity profile for a conveyor of the type having nozzles located between the conveyor rollers.

FIG. 7A shows the air jet velocity profile "a" for a conventional nozzle arrangement of the type disclosed in previously mentioned U.S. Pat. No. 3,930,900. This velocity profile is characterized by pronounced high velocity peaks $P_a$ extending upwardly from the spaces between the rollers 10, and by relatively wide and deep depressions $D_a$ overlying the table rollers. This yields an average velocity $V_a$, with the path travelled by the rod rings across the profile being shown by the cross-hatched areas $A_a$. Although the areas $A_a$ extend across the high velocity peaks $P_a$, the duration of ring exposure to high velocity air flow is relatively brief in comparison to the time taken up by ring travel across the intervening depressions $D_a$.

Figure 7B:
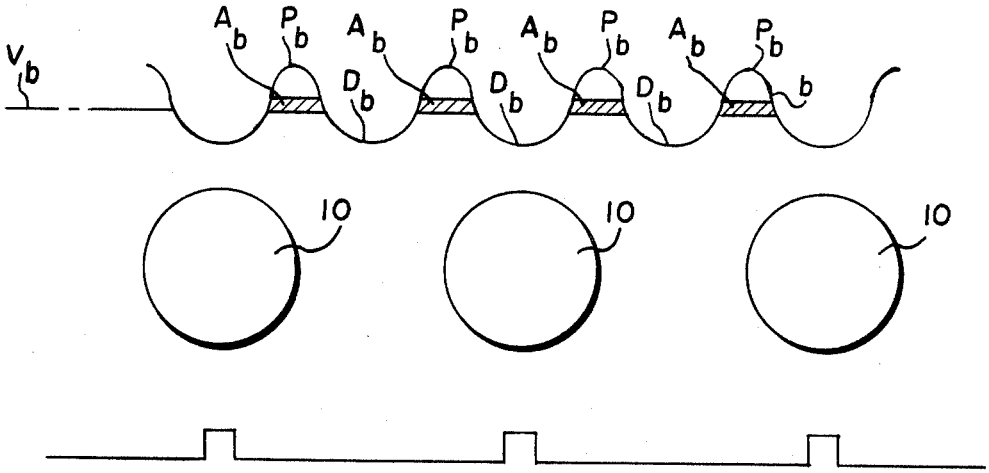
FIG. 7B is a diagrammatic illustration of the air jet velocity profile for a conveyor of the type having nozzles located beneath the conveyor rollers; and, FIG. 7C is a diagrammatic illustration of the air jet velocity profile of a conveyor in accordance with the present invention.

FIG. 7B shows the air jet velocity profile "b" for the nozzle arrangement shown in previously mentioned U.S. Pat. No. 4,448,401. Here, the profile has lower velocity double peaks $P_b$ on either sides of the rollers 10, with depressions $D_b$ overlying not only the rollers 10 but also the spaces therebetween. The path of ring travel across the profile is shown by crosshatched areas $A_b$. The frequency of ring exposure in areas $A_b$ is higher than in the area $A_a$ of the arrangement shown in FIG. 7A. However, the air stream velocity in areas $A_b$ is lower. Thus, the average velocity $V_b$ of the arrangement shown in FIG. 7B is about the same as the average velocity of the arrangement shown in FIG. 7A. As previously mentioned, such arrangements are incapable of generating the rapid cooling rates required to effectively cool the larger rod sizes.

Figure 1:
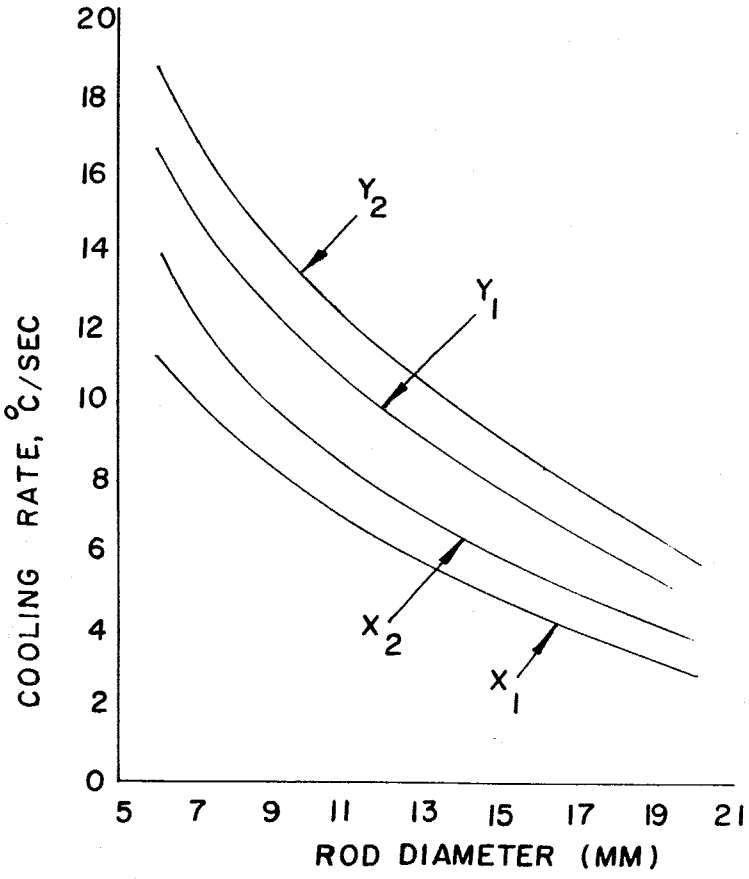
FIG. 1 is a graph comparing the cooling rates of the present invention for various rod sizes with the cooling rates of a conventional air cooling arrangement.
Figure 3:
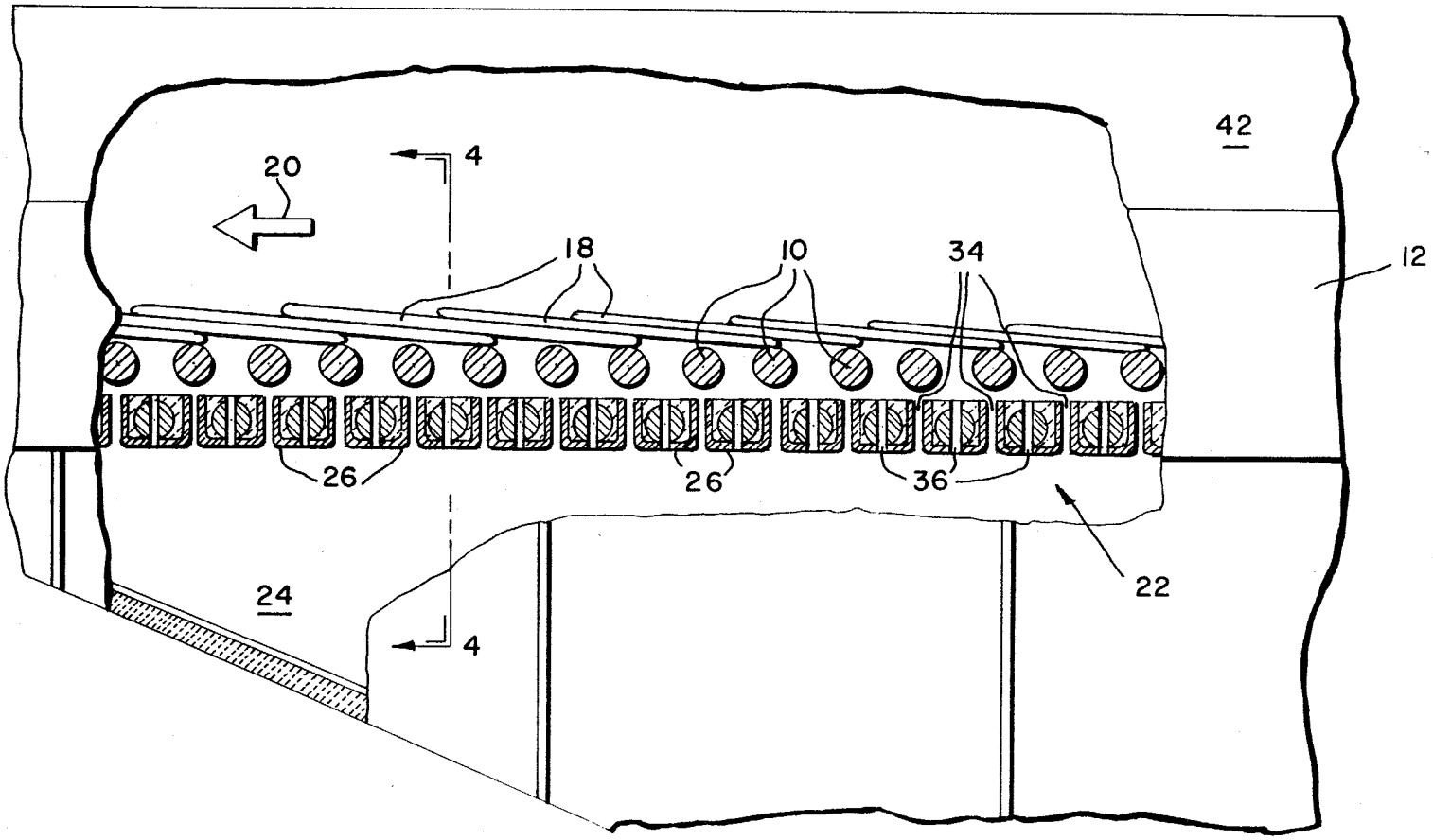
FIG. 3 is a longitudinal sectional view through a portion of a conveyor in accordance with the present invention.
Figure 7C:
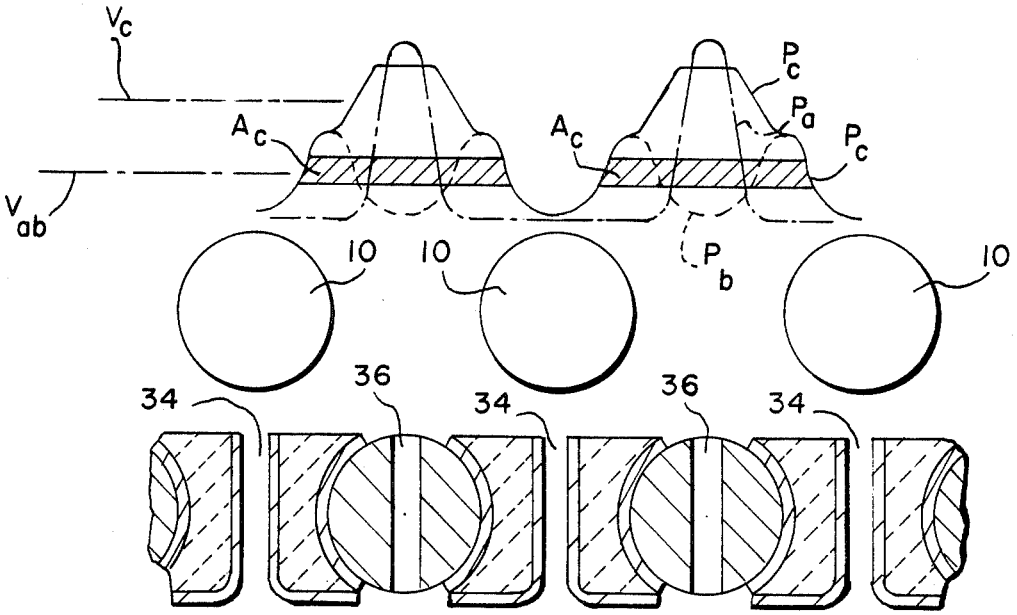

FIG. 7C shows the velocity profile $P_c$ of the present invention. The first nozzles 34 produce the previously described double peak profile shown by broken line $P_b$, and the second nozzles 36 produce the single peak profile shown by broken line $P_a$. If considered individually, both profiles $P_a$ and $P_b$ would yield approximately the same average velocity $V_{ab}$. However, when the two profiles are superimposed one over the other as a result of simultaneous operation of the first and second nozzles 34, 36, the resulting combined profile $P_c$ has a significantly higher average velocity $V_c$ and a broad base portion which fully encompasses the spaces between the rollers 10. The cross-hatched areas $A_c$ illustrate that as the rings move over the spaces between the rollers, they experience continuous exposure to a higher velocity air flow. Experimental data indicates that as a result of this phenomena, it is possible to achieve the significantly higher cooling rates shown by curves $y_1$, $y_2$ of FIG. 1. As shown by the curve Y in FIG. 2, the increased cooling rates make it possible to significantly increase average tensiles to levels closely approximating those attainable with lead patenting. Thus, rods in the larger diameters ranging from 9–19 mm. now can be air cooled, thereby making it unnecessary to resort to the marginally effective and/or higher cost alternatives previously employed.

This advantage is achieved without compromising the ability of the apparatus to also cool products at retarded rather than accellerated rates. Retarded cooling can be accomplished by closing the conveyor covers 42, by adjusting the second nozzles 36 to their closed positions, and by shutting down the supply of cooling air to the plenum 24. With the second nozzles 36 closed, and because the first nozzles 34 are masked by the overlying rollers 10, the rod rings are exposed to a substantially continuous underlying heat reflective surface. This, together with the insulated conveyor side walls 12 and covers 42, retards radiation heat losses and thus substantially retards the rate at which the rod rings will be allowed to cool.

We claim:

1. For use with a conveyor having succesive mutually speed driven rollers on which hot rolled steel rod is transported in the form of overlapping offset rings, apparatus for rapidly air cooling said rings, comprising: first means for directing first jets of cooling air upwardly to impinge against and to flow around said rollers; and second means for directing second jets of cooling air upwardly between said rollers, said first and second jets of cooling air producing respective first and second velocity profiles each having an average velocity, the arrangement of said first and second means in relation to each other and to said rollers being such that the velocity profiles of said first and second jets are superimposed one over the other to produce a combined velocity profile having an average velocity greater than that of either said first or second velocity profiles.

2. The apparatus of claim 1 wherein the velocity profile produced by said first jets has first peaks which reach upwardly from opposite sides of the rollers and which are separated by depressions overlying the rollers and the spaces therebetween.

3. The apparatus of claim 2 wherein said second jets produce a velocity profile having second peaks which reach upwardly from between said rollers to fill the depressions of said first velocity profile which overlie the spaces between said rollers.

4. The apparatus of claim 3 wherein the maximum velocity of said second peaks is greater than the maximum velocity of said first peaks.

5. The apparatus of anyone of claims 2 to 4 wherein said first and second means respectively comprise first and second slots extending transversely across the width of the conveyor and communicating with a common source of pressurized cooling air, said first slots being located beneath said rollers and said second slots being located beneath the spaces between said rollers.

6. The apparatus of claim 5 further comprising means for opening and closing said second slots.

7. Apparatus for rapidly air cooling overlapping offset hot rolled rod rings being transported on mutually spaced driven rollers of a conveyor, comprising:

first means for directing first jets of cooling air upwardly to impinge against and to flow around said rollers, said first jets producing first velocity profiles with first peaks which reach upwardly from opposite sides of said rollers and with depressions which overly said rollers and the spaces therebetween; and second means for directing second jets of cooling air upwardly between said rollers, said second jets producing second velocity profiles with second peaks which reach upwardly between said rollers into the depressions of said first velocity proifile which overly the space between said rollers, said first and second velocity profiles each having average velocities, with the arrangement of said first and second means in relation to each other and to said rollers being such that said first and second velocity profiles are superimposed one over the other to produce a combined velocity profile having an average velocity greater than that of either said first or second velocity profiles.

8. A method of rapidly air cooling overlapping offset hot rolled rod rings being transported on mutually spaced driven rollers of a conveyor, comprising: directing first jets of cooling air upwardly to impinge against and to flow around the rollers while simultaneously directing second jets of cooling air upwardly between the rollers, the first and second velocity profiles respectively produced by said first and second jets being superimposed one over the other to produce a combined velocity profile having an average velocity which is greater than that of either said first or second velocity profiles.

* * * * *